US007425132B2

(12) United States Patent
Yang et al.

(10) Patent No.: US 7,425,132 B2
(45) Date of Patent: Sep. 16, 2008

(54) POWER ADAPTOR WITH RETRACTABLE PLUG

(76) Inventors: Hsien-Lin Yang, 6F., No. 3, Lane 68, San Min Rd., Songshan District, Taipei City (TW); Ming-Yi Tsai, 6F., No. 3, Lane 68, San Min Rd., Songshan District, Taipei City (TW)

( * ) Notice: Subject to any disclaimer, the term of this patent is extended or adjusted under 35 U.S.C. 154(b) by 235 days.

(21) Appl. No.: 11/425,148

(22) Filed: Jun. 20, 2006

(65) Prior Publication Data

US 2007/0293059 A1 Dec. 20, 2007

(51) Int. Cl.
*H01R 39/00* (2006.01)

(52) U.S. Cl. ..... 439/4; 439/131

(58) Field of Classification Search ..... 439/4, 439/131, 103, 171, 172, 174, 136, 140–141, 439/139, 682, 692, 693, 536, 650, 175, 501, 439/173, 696

See application file for complete search history.

(56) References Cited

U.S. PATENT DOCUMENTS 4,078,848 A * 3/1978 Blairsdale ..... 439/103
6,623,294 B2 * 9/2003 Tse et al. ..... 439/501
7,131,852 B1 * 11/2006 Chen ..... 439/131

* cited by examiner

*Primary Examiner*—Edwin A. León
(74) *Attorney, Agent, or Firm*—Leong C. Lei

(57) ABSTRACT

A power adaptor of the present invention has a single power cable connecting between an adaptor body and an electric device. The power cable can be conveniently retrieved or dispensed by a cable winder for easy management. The plug for plugging into a power source is directly installed on the adaptor body. The prongs of the plug is mounted on a sliding rail inside the adaptor body so that the prongs can be stuck out for plugging or completely retracted inside the adaptor body for transportation or storage. Conducting plates are provided along the sliding rail so that the prongs are always in reliable contact with the conducting plates for the conduction of electricity to the electric member inside the adaptor body. When the prongs are fully exposed or when the prongs are completely concealed, the prongs are securely locked to the adaptor body.

3 Claims, 5 Drawing Sheets

POWER ADAPTOR WITH RETRACTABLE PLUG

BACKGROUND OF THE INVENTION (a) Technical Field of the Invention

The present invention generally relates to power adaptors, and more particularly to a power adaptor whose prongs can be retracted and hidden inside the adaptor body.

(b) Description of the Prior Art

Most consumer electronic devices require a power adaptor converting the 110V or 220V AC power into a desired voltage for the device to properly function. As shown in FIG. 6, a conventional power adaptor (e.g., one for a notebook computer) mainly contains an adaptor body A1 connecting two power cables A2. At an end of a first power cable A2, there is a plug A21 for plugging into a power outlet or wall socket for introducing the AC power into the adaptor body A1 for rectification and regulation. The converted voltage is then supplied to the electronic device via the second power cable A2. At an end of the second power cable A2, there is another plug A22 for plugging into the electric device. There are also some adaptors where there is no first power cable A2 and the plug A21 is directly and fixedly provided on the adaptor body A1.

These conventional power adaptors have a number of shortcomings. First of all, for the type of adaptors where the plug is provided on the adaptor body, the protrusion of the plug turns the adaptor body into an irregular shape, which is less convenient to store or carried. On the other hand, the prongs of the plug could easily be deformed when the adaptor is stored or carried with other heavy objects, or the sharp prongs of the plug may scratch or even damage the object or pierce through the bag carrying the adaptor.

Secondly, for the type of adaptors with two power cables, the addition of an extra power cable inevitably increases the product cost. Additionally, the power cables are usually of a certain length for operating the device over a certain distance from the power source. As the lengthy cables are often tangled together, the management of the power cables is always quite troublesome.

SUMMARY OF THE INVENTION

The primary purpose of the present invention is to provide a power adaptor to obviate the foregoing shortcomings of the prior arts.

The power adaptor of the present invention has a single power cable connecting between an adaptor body and an electronic device. The power cable can be conveniently retrieved or dispensed by a cable winder for easy management.

The plug for plugging into a power source is directly installed on the adaptor body. The prongs of the plug is mounted on a sliding rail inside the adaptor body so that the prongs can be stuck out for plugging or completely retracted inside the adaptor body for transportation or storage. Conducting plates are provided along the sliding rail so that the prongs are always in reliable contact with the conducting plates for the conduction of electricity to the electric member inside the adaptor body. When the prongs are fully exposed or when the prongs are completely concealed, the prongs are securely locked to the adaptor body.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
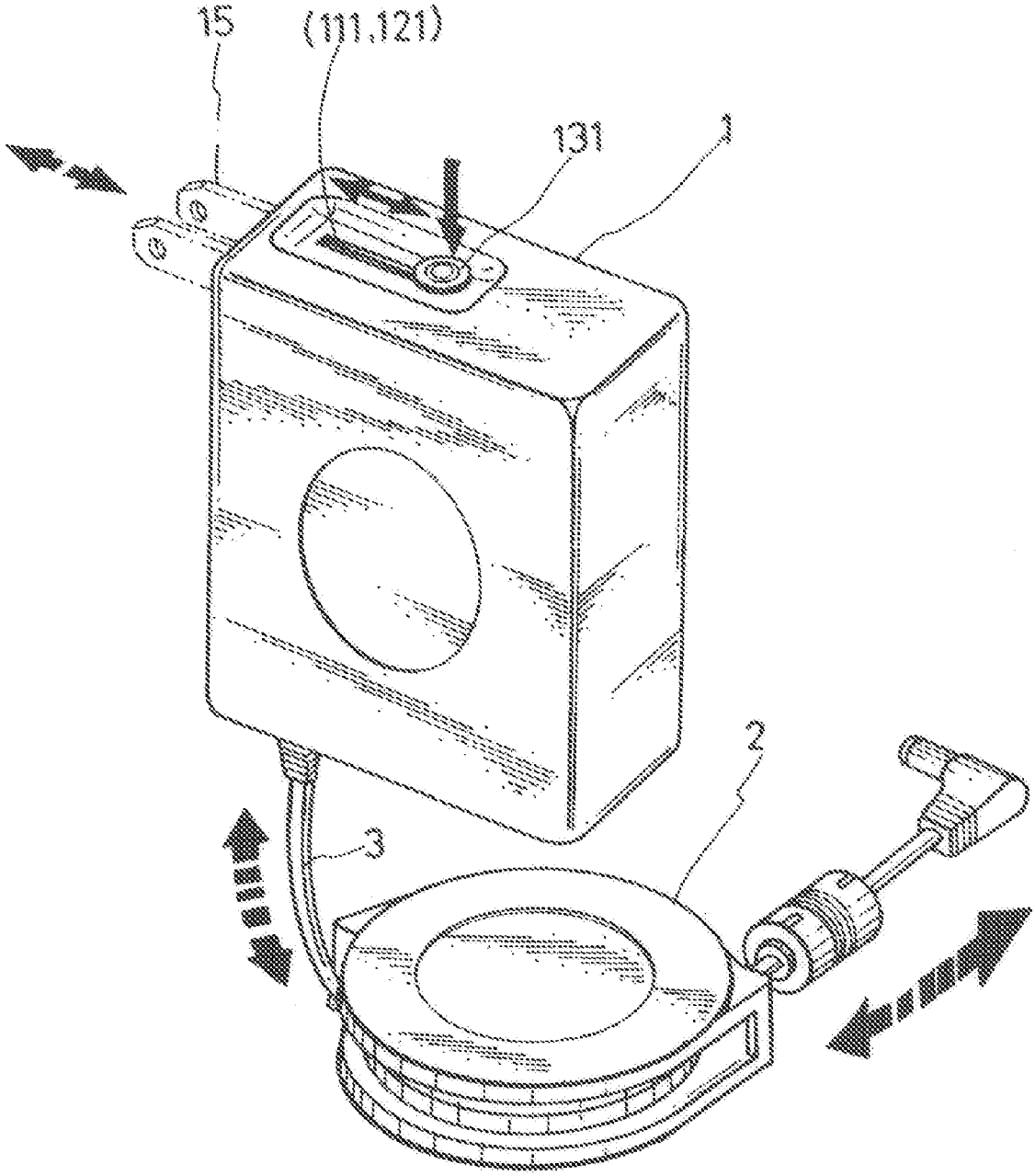
FIG. 1 is a perspective view of a power adaptor according to an embodiment of the present invention.
Figure 2:
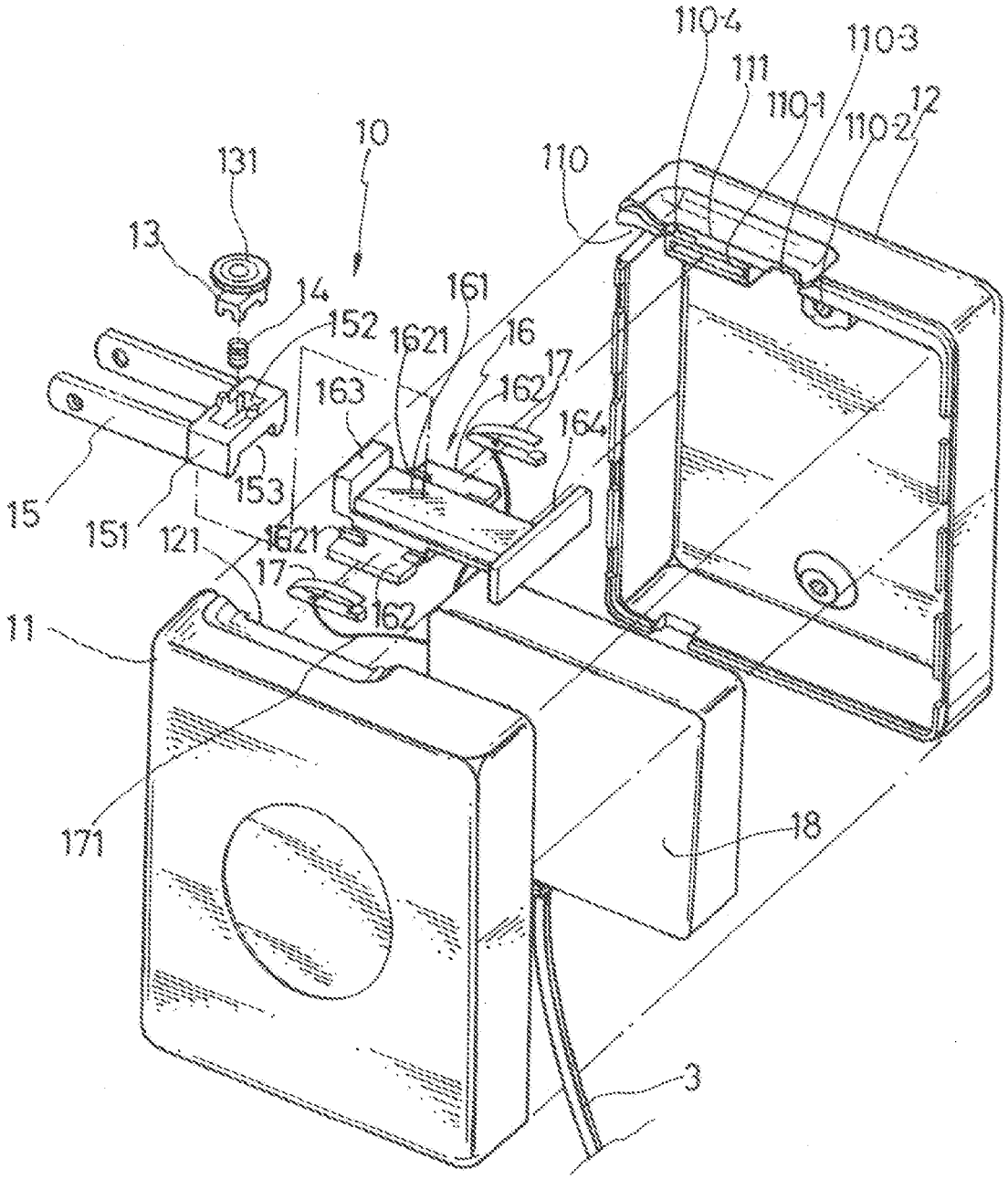
FIG. 2 is a perspective exploded view of the power adaptor of FIG. 1.

As shown in FIG. 1, a power adaptor according to an embodiment of the present invention contains an adaptor body 1 and a power cable 3 which is wound around a cable winder 2. The cable winder 2 is one of the prior arts and is capable of retrieving and dispensing the power cable 3 in both directions. As shown in FIG. 2, the adaptor body 1 mainly contains a first casing member 11 and a second casing member 12 joined together to form a closed space for housing the other components of the adaptor body 1. On the top surfaces of the rectangular bodies of the casing members 11 and 12, matching troughs 121 and 111 are respectively provided so that, when the two casing members 11 and 12 are joined together, an elongated cavity and a through slot therewithin are formed. A head piece 131 of a push button is provided inside the cavity formed by the troughs 121 and 111 and the push button can be slid along the slot and within the confinement of the cavity.

A plug assembly 10 is housed inside the adaptor body 1. The plug assembly, like the common two-prong plug of small appliances, has two prongs 15 whose back ends are fixedly attached to a connecting piece 151. On a top surface of the connecting piece 151, a trough 152 capable of receiving the body 13 of the push body and an elastic element 14 (such as a helix spring) beneath the push button body 3 is provided. When the head piece 131 of the push button is pressed, the body 13 will sink into the trough 152, compressing the elastic element 14. When the head piece 131 is released, the resilience of the elastic element 14 will raise the body 13 out of the trough 152. On the front surface of the adaptor body 1, an opening 110 is provided through which the prongs 15 can be stuck out or retracted in the adaptor body 1.

As shown in FIG. 2, the plug assembly 10 further contains a sliding piece 16 having a sliding rail 161 sandwiched between two stopping blocks 163 and 164. The connecting piece 151 has a track 153 on the bottom surface (opposite to the top surface where the trough 152 is located) that can be positioned on and slid along the sliding rail 161 within the confinement of the stopping blocks 163 and 164. The sliding piece 16 further contains two wings 162 extended symmetrically and perpendicularly from the sides of the sliding rail 161. On the top surface of the wings 162, there are two protruding positioning blocks 1621 which confine two conducting plates 17 along the two sides of the sliding rail 161 respectively. On the inner surfaces of the casing members 11 and 12, there are two receiving sockets 110-1 for the accommodation of the two wings 162 so that the sliding piece 16 is fixedly held inside the adaptor body 1. To further enhance the steadiness of the sliding piece 16, the stopping block 163 is embedded in the opening 110 (but leaving the room for the penetration of the prongs 15) and the two ends of stopping block 164 are plugged into another two receiving sockets 110-2 on the two inner side surfaces of the casing members 11 and 12 respectively.

The conducting plates 17 are arched elastically upward to have a constant and reliable contact with the prongs 15 wherever the prongs 15 are slid along the sliding rail 161. When the prongs 15 are plugged into a power outlet, the electricity is conducted through the prongs 15, the conducting plates 17, and wires 171 to an electric member 18 for rectification and regulation into the desired voltage. The voltage is then provided through the power cable 3 to a connected electronic device.

Figure 3:
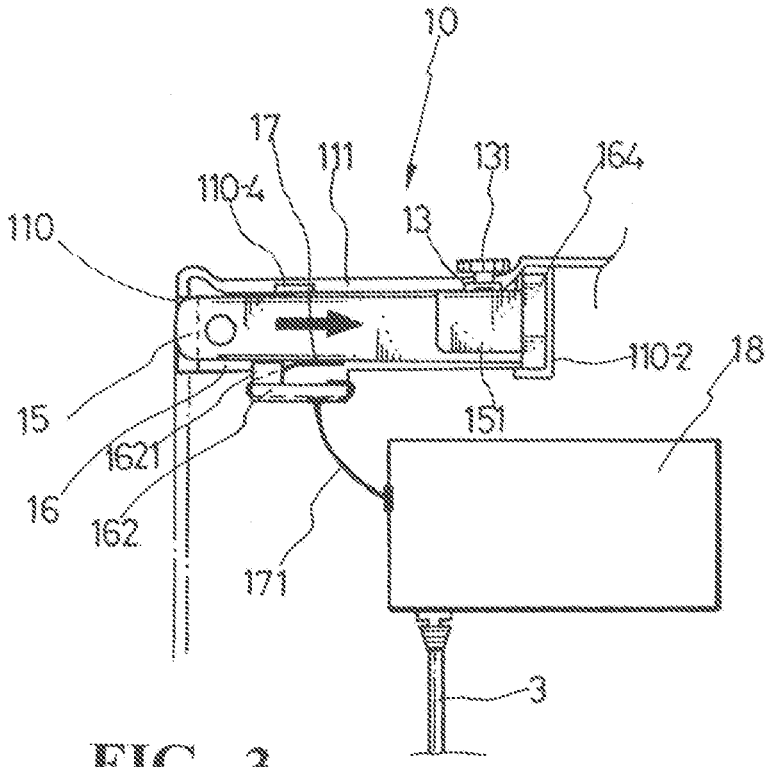
FIG. 3 is a sectional view of the power adaptor of FIG. 1 showing the complete concealment of the prongs.
Figure 4:
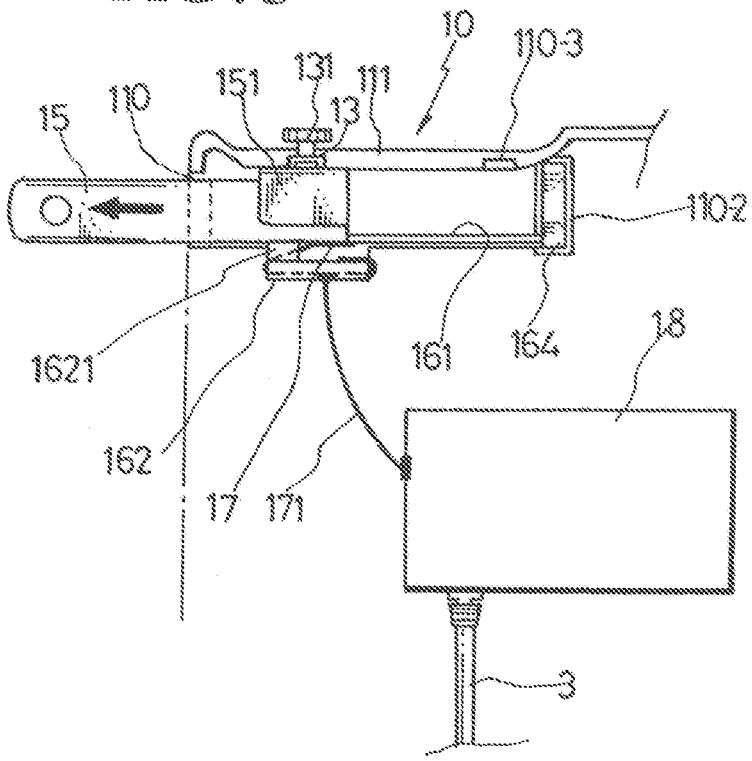
FIG. 4 is a sectional view of the power adaptor of FIG. 1 showing the full exposure of the prongs.

As shown in FIGS. 3 and 4, when he prongs 15 are completely retracted into adaptor body 1, the push button body 13 by the resilience of the elastic element 14 will be embedded into a locking trough 110-3 formed on the top inner surfaces of the casing members 11 and 12 behind the cavity so that the prongs 15 are securely hidden inside the adaptor body 1. Then, by pressing the head piece 131 to compress the elastic element 14 and to release the push button body 13 out of the locking trough 110-3, the head piece 131 can be pushed forward to stick out the prongs 15. When the connecting piece 151 is stopped by the stopping block 163 and when the head piece 131 is released, again by the resilience of the elastic element 14, the push button body 13 will be embedded into another locking trough 110-4 also formed on the top inner surfaces of the casing members 11 and 12 in front of the cavity. Similarly, to retract the prongs 15, the head piece 131 is pressed to release the push button body 13 out of the locking trough 110-4 and is pulled backward until the connecting piece 151 is stopped by the stopping block 164. When the head piece 131 is released, again by the resilience of the elastic element 14, the push button body 13 will be embedded into the locking trough 110-3.

Figure 5:
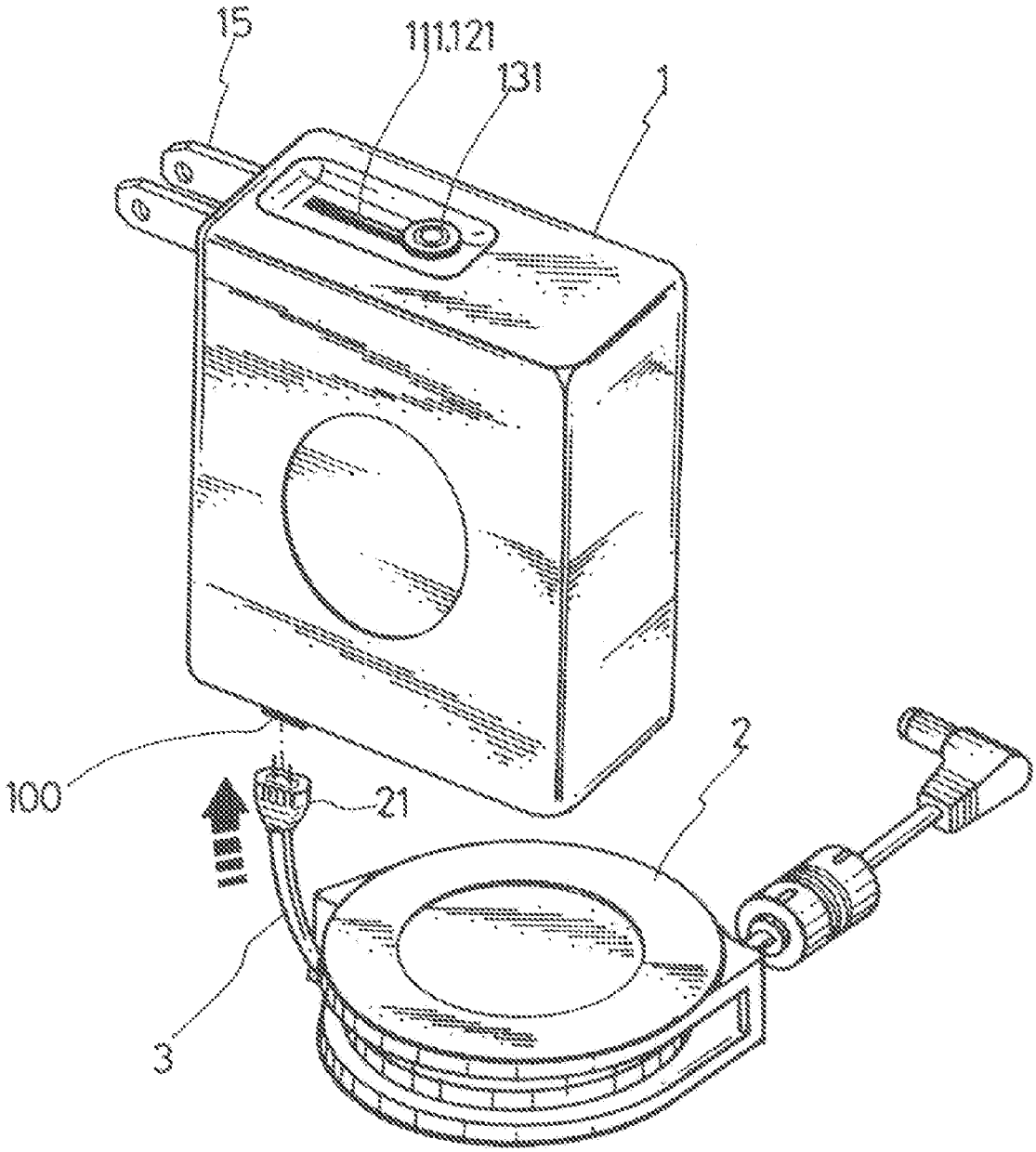
FIG. 5 is a perspective view of a power adaptor according to another embodiment of the present invention.
Figure 6:
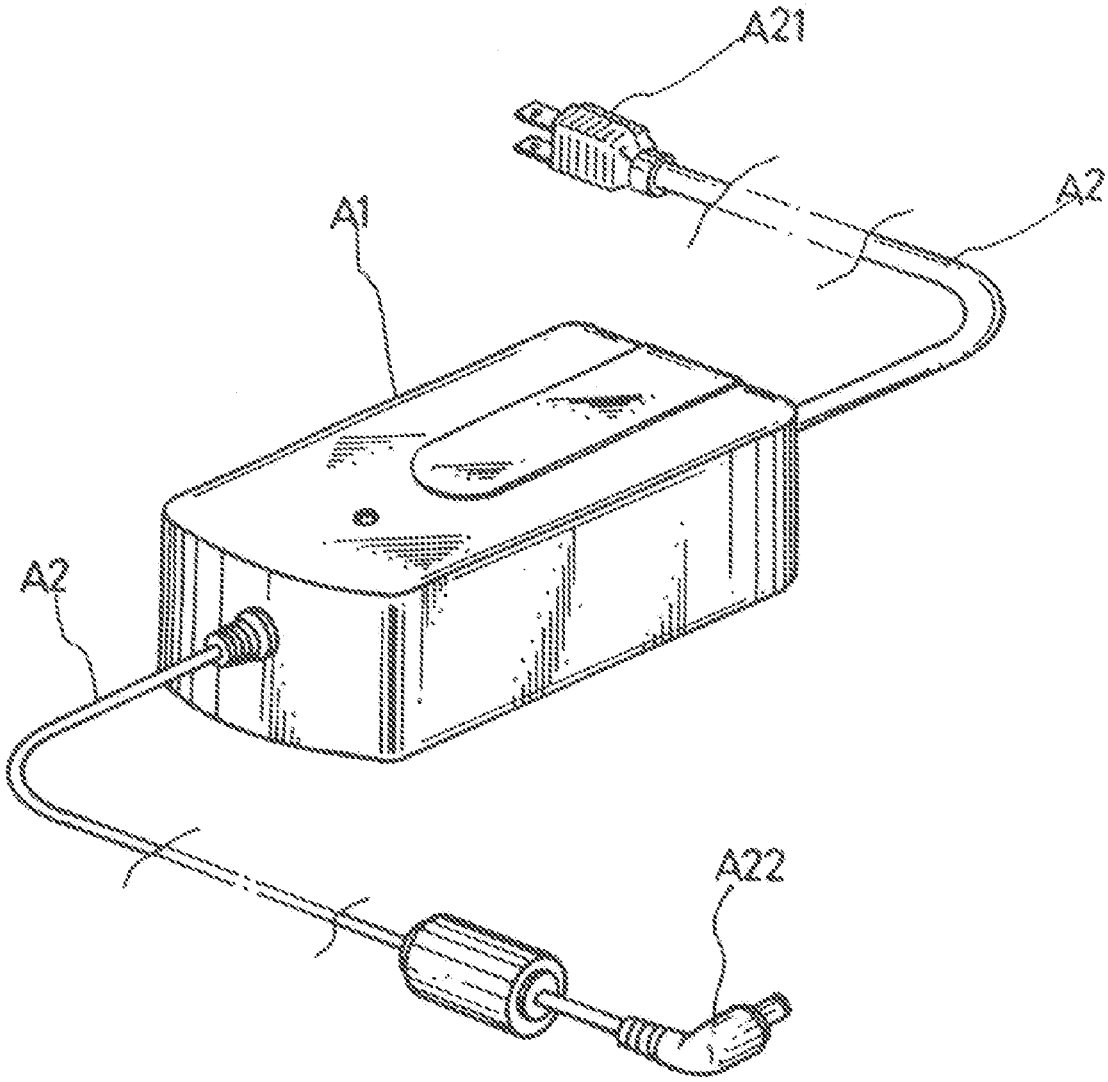
FIG. 6 PRIOR ART
FIG. 6 is a perspective view of a conventional power adaptor.

The connection of the power cable 3 to the adaptor body 1 could be a fixed one as shown in FIG. 1 or detachable one as shown in FIG. 5 by having a socket 21 on the adaptor body 1 and a matching plug 21 at an end of the power cable 3.

It will understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in a way from the spirit of the present invention.

We claim:

1. A power adaptor having an adaptor body and a power cable connecting to said adaptor body at one end, wherein said adaptor body has an elongated cavity and a through slot therewithin on a top surface, an opening on a front surface adjacent to said top surface, a first and a second locking troughs on the inner surface beneath said top surface on the front and back of said cavity respectively, a pair of first receiving sockets and a pair of second receiving sockets on two opposing inner side surfaces of said adaptor body;

a plug assembly housed inside said adaptor body has two prongs whose back ends are fixedly attached to a connecting piece, a sliding rail sandwiched between a first stopping block and a second stopping block embedded into said opening and said second receiving socket respectively;

said connecting piece has a trough on a top surface and a track on an opposite bottom surface that is slidably mounted on said sliding rail;

a push bottom has a head piece slidably positioned within said cavity and connected to a body housed inside said adaptor body via said slot; said body and an elastic element are received by said trough of said connecting piece;

said sliding rail has two wings extended from the sides of said sliding rail and embedded into said first receiving sockets respectively;

two conducting plates arched elastically upward are provided along the two sides of said sliding rail so as to have constant contact with said two prongs as they are slid along said sliding rail;

an electric member for voltage regulation and rectification is housed inside said adaptor body and is electrically connected to said conducting plates;

when said prongs are completely retracted into said adaptor body, said body of said push button by the resilience of said elastic element is embedded into said second locking trough;

to expose said prongs, said head piece is pressed to compress said elastic element and to release said body of said push button out of said second locking trough, said head piece is pushed forward along said cavity to stick out said prongs via said opening; when said connecting piece is stopped by said first stopping block and when said head piece is released, again by the resilience of said elastic element, said body of said push button is embedded into said first locking trough;

to retract said prongs, said head piece is pressed to release said body of said push button out of said first locking trough and is pulled backward along said cavity until said connecting piece is stopped by said second stopping block; and when said head piece is released, again by the resilience of said elastic element, said body of said push button is embedded into said second locking trough.

2. The power adaptor according to claim 1, further comprising a cable winder around which said power cable is wound, said cable winder capable of retrieving and dispensing said power cable in both directions.

3. The power adaptor according to claim 1, wherein said power cable is detachable from said adaptor body.

* * * * *